US006739589B2

(12) United States Patent
Hiramatsu

(10) Patent No.: US 6,739,589 B2
(45) Date of Patent: May 25, 2004

(54) SHEET MATERIAL CONVEYING APPARATUS AND RECORDING APPARATUS

(75) Inventor: Souichi Hiramatsu, Hachioji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/793,128

(22) Filed: Feb. 27, 2001

(65) Prior Publication Data

US 2001/0017439 A1 Aug. 30, 2001

(30) Foreign Application Priority Data

Feb. 29, 2000 (JP) ..... 2000-053772

(51) Int. Cl.[7] ..... B65H 29/00

(52) U.S. Cl. ..... 271/184; 271/185; 271/186; 271/10.11; 271/275; 271/10.04

(58) Field of Search ..... 271/264, 10.11, 271/10.12, 273, 275, 184, 185, 186, 225, 276

(56) References Cited

U.S. PATENT DOCUMENTS

| | | | | |
|---|---|---|---|---|
| 3,856,132 A | * | 12/1974 | Sakurai et al. | 198/457.05 |
| 4,304,485 A | | 12/1981 | Povio | 355/3 SH |
| 4,629,178 A | | 12/1986 | Waddell et al. | 271/251 |
| 5,648,808 A | | 7/1997 | Yanagi et al. | 347/104 |
| 5,867,196 A | | 2/1999 | Kiyohara et al. | 347/104 |
| 5,992,993 A | | 11/1999 | Kiyohara et al. | 347/104 |
| 6,095,515 A | | 8/2000 | Kiyohara et al. | |
| 6,130,762 A | * | 10/2000 | Hwang et al. | 358/498 |
| 6,168,270 B1 | | 1/2001 | Saikawa et al. | 347/104 |

FOREIGN PATENT DOCUMENTS

| | | | |
|---|---|---|---|
| EP | 0 622 221 | | 11/1994 |
| EP | 0 945 378 | | 9/1999 |
| GB | 2 126 992 | | 4/1984 |
| JP | 5-116827 | * | 5/1993 |
| JP | 5-319633 | * | 12/1993 |

* cited by examiner

*Primary Examiner*—Donald P. Walsh
*Assistant Examiner*—Jonathan R Miller
(74) *Attorney, Agent, or Firm*—Fitzpatrick, Cella, Harper & Scinto

(57) ABSTRACT

The present invention relates to a sheet material conveying apparatus comprising first conveying means for conveying a sheet, material second conveying means for conveying, on a downstream side in a sheet material conveyance direction of the first conveying means, the sheet material and a plurality of guide members for forming a curving conveyance route located between the first conveying means and the second conveying means. The guide member forms the curving conveyance route located on an inner side among the guide members is a rotary body rotatably, which is arranged with no pressing member for pressing the sheet material to the rotary body.

19 Claims, 12 Drawing Sheets

SHEET MATERIAL CONVEYING APPARATUS AND RECORDING APPARATUS

BACKGROUND OF THE INVENTION

1. Field of the Invention

This invention relates to a sheet materials conveying apparatus having a curving conveyance route placed among conveying means and to, for example, a sheet material conveying apparatus used for recording apparatuses such as printers, photocopiers, and facsimile machines.

2. Description of Related Art

Conventionally, a serial recording apparatus, as a recording apparatus of this type, has been known in which making recording on a surface of a recording medium in moving a carriage mounting a recording head in a width direction perpendicular to the recording medium conveyance direction. With this serial recording apparatus, images are recorded on the recording media in repeating alternatively conveyance of the recording media and recording with the carriage doing scanning.

Known also is a line recording apparatus in which a recording head having a substantially recording medium width is mounted to convey the recording media and to record images on the recording media in the width direction.

On the other hand, increasing number is an apparatus having the following structure that can be used commonly for both types. The apparatus automatically feeds, by a feeding means, recording media held at a recording medium holding member such as tray, cassette, or the like, and conveys the recording media to a conveying means via a curving conveyance route.

For example, as shown in FIG. 11, a recording medium fed in a right direction in FIG. 11 from a tray 100 serving as a recording paper holding member by means of a feeding roller 101 as a feeding means is fed to a paper feeding roller 102 as a conveying means in a left direction in FIG. 11 via a conveyance route curving in a U-turn shape. Placing such a curving conveyance route can render the recording apparatus compact and the recording medium or paper easily handled by the users.

Recently, high quality images are demanded, and while high resolution printing can be realized by the above recording head, such recording apparatuses seek to raise conveyance accuracy of the recording material.

In a case that the recording apparatus is made thus compact and that the conveyance route from the feeding roller 101 serving as the feeding means to the paper feeding roller 102 serving as the conveying means is made of a conveyance route curving in the U-turn shape, such a recording apparatus may poses the following problems.

For example, as shown in FIG. 11, where the conveyance route curving in the U-turn shape is formed of a guide-rail-shaped stable member 105, the recording medium may be first subject to lower conveyance accuracy when the feeding roller 102 conveys the recording medium. This is because when the feeding roller 102 receives the recording medium, the rear end of the recording medium is still located at the curving conveyance route, and consequently, a rear side load occurs. Particularly, when the recording medium or the like having a thick thickness is conveyed, the rigidity of the recording medium increases the load, thereby rendering the conveyance accuracy apparently impaired.

Second, when the recording medium is sent to the conveyance roller 102 by the feeding roller 101, large resistance force occurs because the front end of the recording medium passes through the curving conveyance route. Similarly to the first problem, particularly when the recording medium or the like having a thick thickness is conveyed, the rigidity of the recording medium produces larger resistance force, and this resistance force may induce slip of the feeding roller 101. To avoid this, the feeding roller 101 has to receive feeding force overcoming the above resistance force, and therefore, the torque of the drive source and the strength of the feeding roller 101 have to be increased, so that such an apparatus may invite higher production costs.

To solve the above problems (namely, first, rear side load for the paper feeding roller 102 as a conveyance means, second, front side resistance for the feeding roller 101 as a feeding means), a structure shown in FIG. 12 has been proposed. A feeding roller 103 is provided at the curving conveyance route portion, in comparison with FIG. 11, and pressing rollers 104 are provided as pressing members for pressing the recording medium against the feeding roller 103.

This structure, the recording medium held in the recording holding member such as a tray or cassette is fed to the feeding roller 103 by the feeding roller 101. The recording medium clamped with the feeding roller 103 and the pressing roller 104 is sent to the conveying roller 102 according to the rotation of the feeding roller 103. While the recording medium is conveyed by the conveying roller 102, the feeding roller 103 rotates at the same time in association with the above conveyance.

According to this structure, the above problems (first, rear side load for the paper feeding roller 102 as a conveyance means, second, front side resistance for the feeding roller 101 as a feeding means) can be solved, but the following new problems may be posed by the conveyance function of the feeding roller 103 and the pressing roller 104. If the conveyance amount of the feeding roller 103 is small with respect to the paper feeding roller 102, rear side load may remain, and conversely, if the conveyance amount of the feeding roller 103 is large, force on a pushing side may work, even though the rear side load becomes subtle, so rendering worse the conveyance accuracy in the same way as of the rear side load. Moreover, vibrations made when the rear end of the recording medium comes out of the nip portion between the feeding roller 103 and the pressing roller 104 may render worse the conveyance accuracy.

The apparatus has a structure that the pressing roller 104 is pressed onto the feeding roller 103, so that a load is exerted to the feeding roller 103, and that extra drive force is required for this structure. Therefore, the torque of the drive source that provides drive force to the feeding roller 103 is necessarily increased, and consequently, the apparatus may increase the product costs.

This invention is conceived to solve the above problems on the conventional arts. It is an object of the invention to provide an apparatus preventing the conveyance accuracy from becoming worse during recording medium conveyance by the conveying means according to formation of the curving conveyance route between the feeding means and the conveying means and also preventing the product costs for larger drive force from becoming higher.

SUMMARY OF THE INVENTION

A representative structure according to this invention to accomplish the above object is including first conveying means for conveying a sheet material; second conveying means for conveying, on a downstream side in a sheet material conveyance direction of the first conveying means, the sheet material; and a plurality of guide members for forming a curving conveyance route located between the first conveying means and the second conveying means, wherein the guide member forming the curving conveyance route located on an inner side among the guide members is a rotary body rotatably, which is arranged with no pressing member for pressing the sheet material to the rotary body.

According to the above structure, among the guide members forming the curving conveyance route between the first conveying means and the second conveying means, the guide member located on an inner side is formed of a rotatable rotary body, and the structure has no pressing member for pressing the sheet material to the rotary body, so that the apparatus can prevent the conveyance accuracy from becoming worse during recording medium conveyance by the conveying means and also prevent the product costs for increasing conveyance power of the conveying means from becoming higher.

DESCRIPTION OF THE PREFERRED EMBODIMENTS

Figure 1:
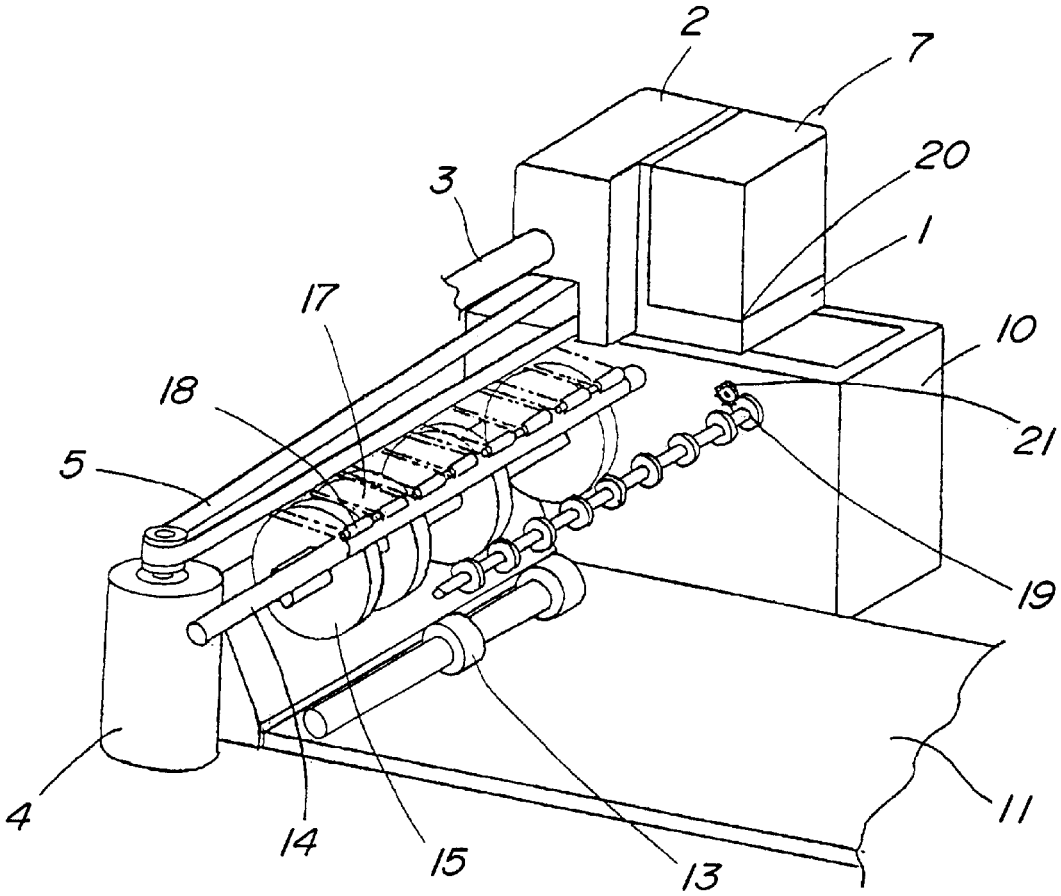
FIG. 1 is a perspective view schematically showing an outlined structure of a recording apparatus having a recording head performing recording according to an inkjet method as an embodiment of the invention.

Referring to the drawings, preferred embodiments of this invention are described below. It is to be noted that in the embodiments below, exemplified are recording apparatuses having sheet material conveying apparatus to which this invention applies.

FIG. 1 is a perspective view schematically showing an outlined structure of a recording apparatus having a recording head performing recording according to an inkjet method as an embodiment of the invention. In the following embodiments, as shown in FIG. 1, a recording head 1 as a recording means is made of an ink tank 7 for supplying ink to the recording head, and an ink cartridge 20 formed unitedly with the ink tank 7.

The recording head as the recording means, among inkjet recording methods, has a means for generating thermal energy as energy utilized for ink spraying and achieves high density and high definition recording by using a method in which changes of ink's state can be created by the thermal energy.

In FIG. 1, the recording head 1 is mounted on a carriage 2 with a position for spraying ink downward, and forms images on a sheet material, not shown, such as recording paper or the like, by spraying ink droplets in travelling the carriage 2 along a guide shaft 3. Left and right movements (reciprocal movement) of the carriage 2 is produced by rotation of a carriage motor 4 via a timing belt 5.

When recording for one scanning line of the recording head 1 ends, the recording operation is interrupted, and the sheet material located on a platen roller is conveyed by a prescribed amount with a conveyance roller 14 from drive of a feeding motor, not shown. Subsequently, the carriage 2 is moved again along the guide shaft 3 to form the image of the subsequent scanning line.

A recovery unit 10 is provided on a right side of the apparatus for recovery operation to maintain the ink spraying state at a good condition at the recording head 1. Though not shown with details, the recovery unit 10 includes a cap for capping the recording head 1, a wiper for wiping the ink spraying surface of the recording head 1, a sucking pump for sucking ink from the ink spraying nozzle of the recording head 1, and so on.

[First Embodiment]

Figure 2:
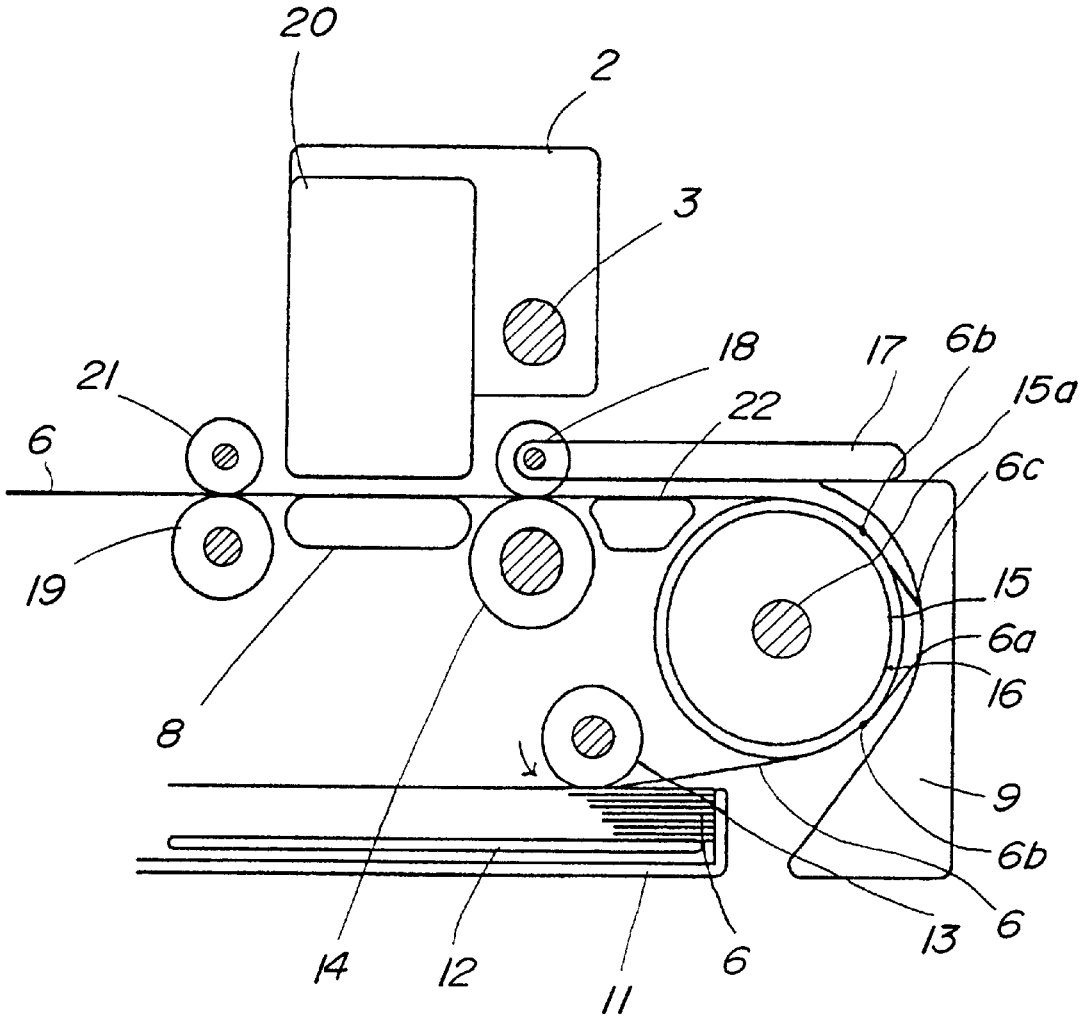
FIG. 2 is a cross section showing an essential structure of the recording apparatus according to the first embodiment of the invention.

The first embodiment of the invention is described using FIG. 2. FIG. 2 is a cross section showing an essential structure of the recording apparatus according to the first embodiment of the invention.

As shown in FIG. 2, a recording paper (sheet material) 6 stacked on a recording paper holding member (sheet material holding means) 11 is pressed on a feeding roller 13 constituting a first conveying means by way of a pressing plate 12 urged by a pressing plate spring, not shown. When the feeding roller 13 is rotated in arrow direction in FIG. 2, the topmost recording paper 6 is fed between a U-turn guide 9 forming a curving conveyance route and a U-turn roller 15 serving as a rotary body. The U-turn roller 15 forming this curving conveyance route has an outer peripheral portion to which a U-turn roller rubber 16 is attached, and is mounted in the apparatus as to rotatable around a U-turn roller bearing as driven along conveyance of the recording paper 6.

The U-turn roller 15 is made of a low friction resistance synthetic resin including a shaft portion 15*a*. The U-turn roller rubber 16 serving as the outer peripheral portion of the U-turn roller 15 has a frictional coefficient higher than that of the shaft portion 15*a*. The frictional coefficient of the U-turn roller rubber serving as the surface of the U-turn roller 15 is set to 0.5 or higher.

The recording paper 6 fed from a gap between the U-turn guide 9 and the U-turn roller 15 by feeding force of the feeding roller 13 is guided to a pinch roller guide 17 and a lower guide 22 and introduced to a conveying roller 14 constituting a second conveying means and a pinch roller 18.

Then, the drive force of the feeding roller 13 is cut off, and the recording paper 6 pressed to the conveying roller 14 by the pinch roller 18 urged by a pinch roller spring or pinch roller springs, not shown is fed on a platen roller 8 by conveyance force of the conveying roller 14.

The recording paper 6 fed on the platen roller 8 is subject to printing with the ink cartridge 20 on the carriage 2 as described above.

A delivery roller 19 and a delivery spur 21 are disposed on a downstream side of the recording paper 6 for serving for holding and delivering the recording paper 6.

When the topmost recording paper 6 is fed by the feeding roller 13 to the gap between the U-turn guide 9 and the U-turn roller 15, the recording paper 6 is fed as a front end 6*a* proceeds along the U-turn guide 9 and as a roller contact portion 6*b* proceeds along the U-turn roller rubber 16.

Figure 11:
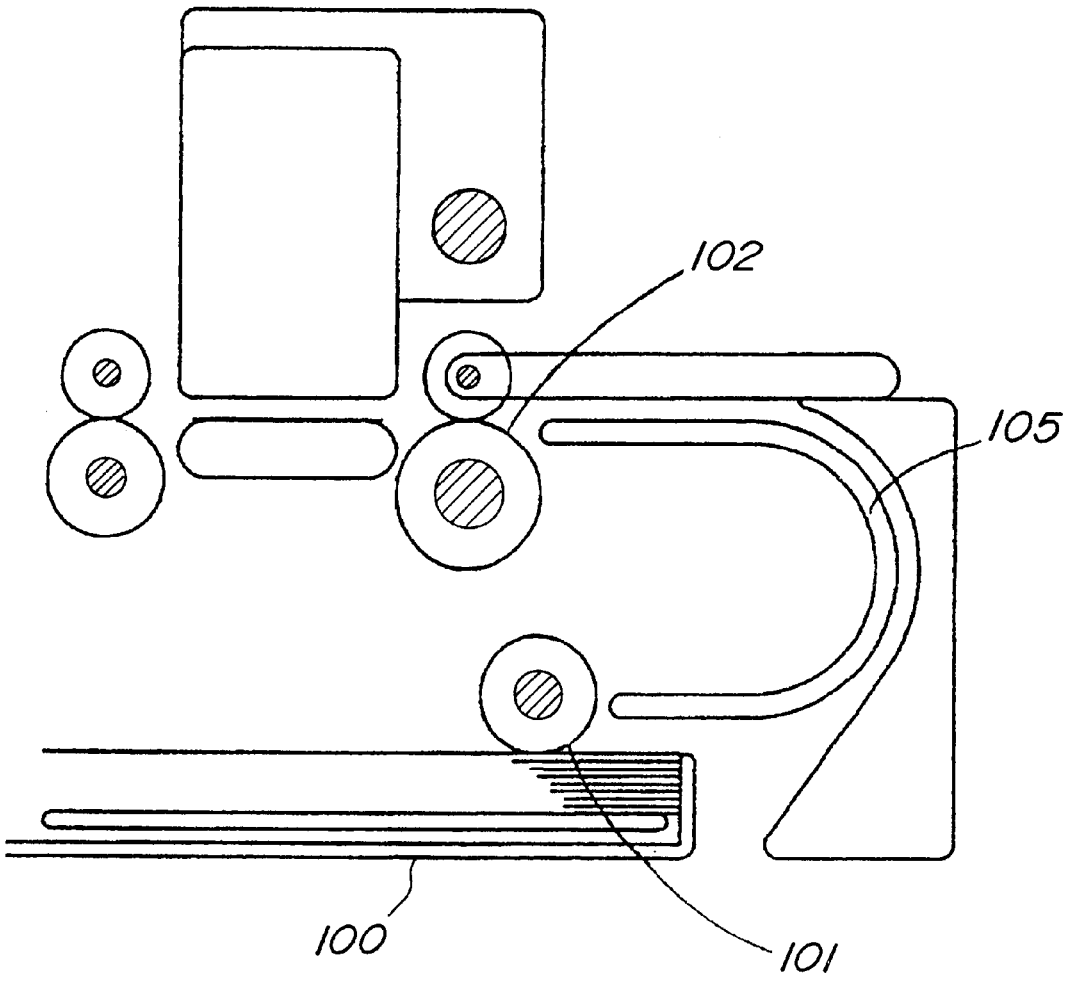
FIG. 11 is a cross section showing a conventional recording apparatus.

If the U-turn roller 15 is stable, for example, if it is a stable guide (see, FIG. 11) as in the prior art, the feeding roller is subject to resistance on the front side of the roller 13 due to frictional force or the like between the guide contact portion corresponding to the roller contact portion of the recording paper and the stable guide. However, where the U-turn roller 15, as a guide member located on an inner side forming the curving conveyance route, is attached rotatably as this embodiment shown in FIG. 2, the front side resistance with respect to the feeding roller 13 is greatly reduced during the conveyance of the recording paper as described above.

If the U-turn roller 15 is immobilized, for example, if it is the stable guide as in the prior art (see, FIG. 11), a rear side load with respect to the conveying roller may occur due to frictional force or the like between the guide contact portion corresponding to the roller contact portion 6*b* of the recording paper where the rear end 6*c* of the recording paper 6 is not yet passing over the U-turn guide 9. However, where the U-turn roller 15, as a guide member located on an inner side forming the curving conveyance route, is attached rotatably as this embodiment shown in FIG. 2, the rear side load with respect to the conveying roller 14 is greatly reduced during the conveyance of the recording paper as described above.

It is to be noted that by rendering thin the U-turn roller shaft portion 15*a* of the U-turn roller 15 as the guide member located on an inner side forming the curving conveyance route, and further by forming by a material having a low frictional coefficient, the U-turn roller 15 can reduce the rotation load, so that this structure becomes advantageous.

As described above, the guide member located on an inner side forming the curving conveyance route between the rollers 14, 16 is formed by the rotatable U-turn roller 15, and the guide member is structured to have no pressing member such as pressing roller which presses onto the U-turn roller 15, so that the apparatus, unlike the conventional technology, does not invite worse conveyance accuracy during recording paper conveyance by the conveying roller 14 and increased product costs for enhancing feeding power of the feeding roller 13.

[Second Embodiment]

Figure 3:
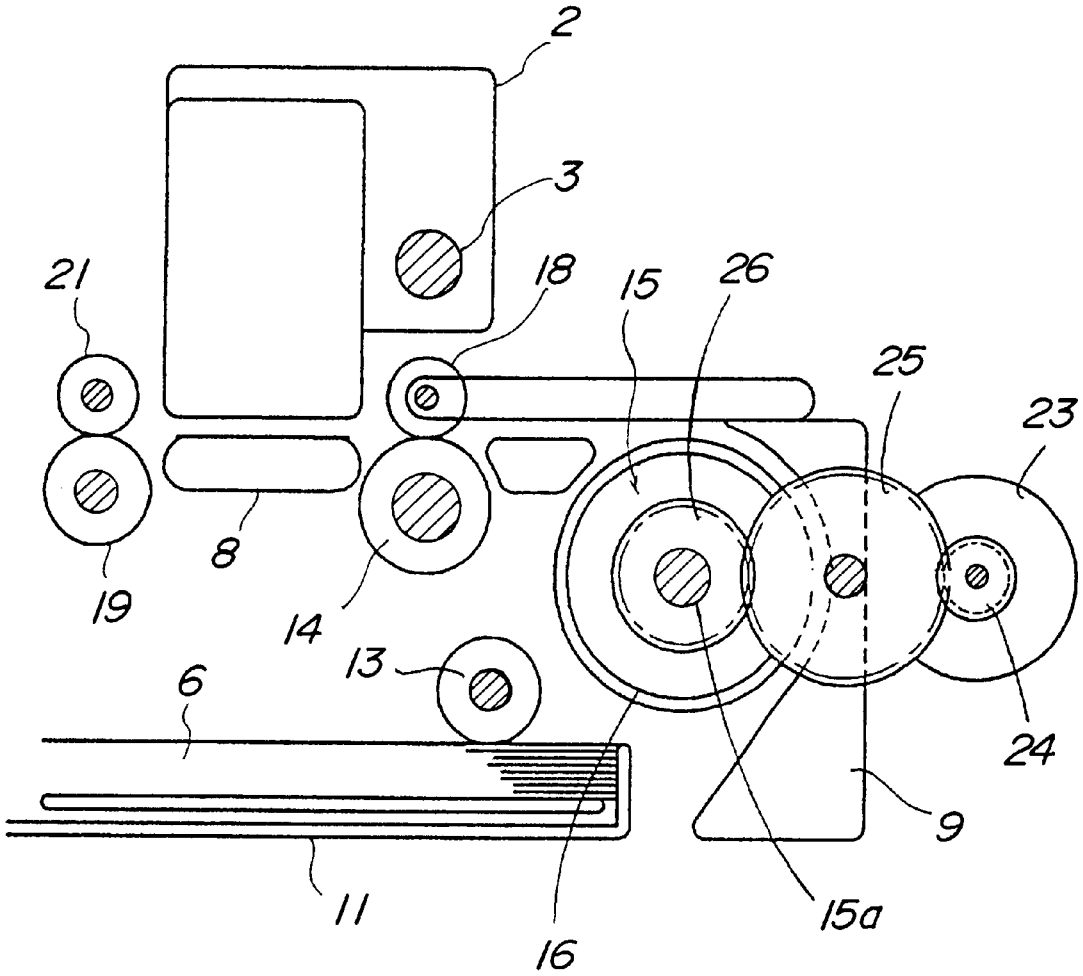
FIG. 3 is a cross section showing an essential structure of a recording apparatus according to the second embodiment of the invention.

Next, referring to FIG. 3, the second embodiment of the invention is described. FIG. 3 is a cross section showing an essential structure of a recording apparatus according to the second embodiment of the invention.

Although the U-turn roller 15 is rotatable in the structure of the above first embodiment shown in FIG. 2, the structure does not rotate by drive force produced by itself. In this embodiment, as shown in FIG. 3, a U-turn roller motor 23 as driving means is provided as shown in FIG. 3, and the U-turn roller 15 is driven to rotate by itself upon receiving drive force given to a U-turn roller gear 26, which is stable to the U-turn roller 15, via an idle gear 25 from a drive gear 24. Therefore, the U-turn roller 15 thus driven to rotate sends the recording paper 6 actively, so that the front side resistance of the feeding roller 13 and the rear side load of the conveyance roller 14 are further reduced.

It is to be noted that in the same manner as in the first embodiment, the recording paper 6 is not conveyed as pressed by the U-turn roller 15, the conveyance force of the U-turn roller 15 does not affect the conveyance accuracy.

Where the U-turn roller 15, as a guide member located on an inner side forming the curving conveyance route, is formed with the U-turn roller shaft portion 15*a* having a small diameter as well as being formed of a material having a low frictional coefficient, whereas the outer peripheral portion of the U-turn roller 15 is made of the U-turn roller rubber 16 made of a material having a high frictional coefficient, the U-turn roller 15 can further advantageously reduce the front side resistance of the feeding roller 13 and the rear side load of the conveyance roller 14 as described above.

[Third Embodiment]

Figure 4:
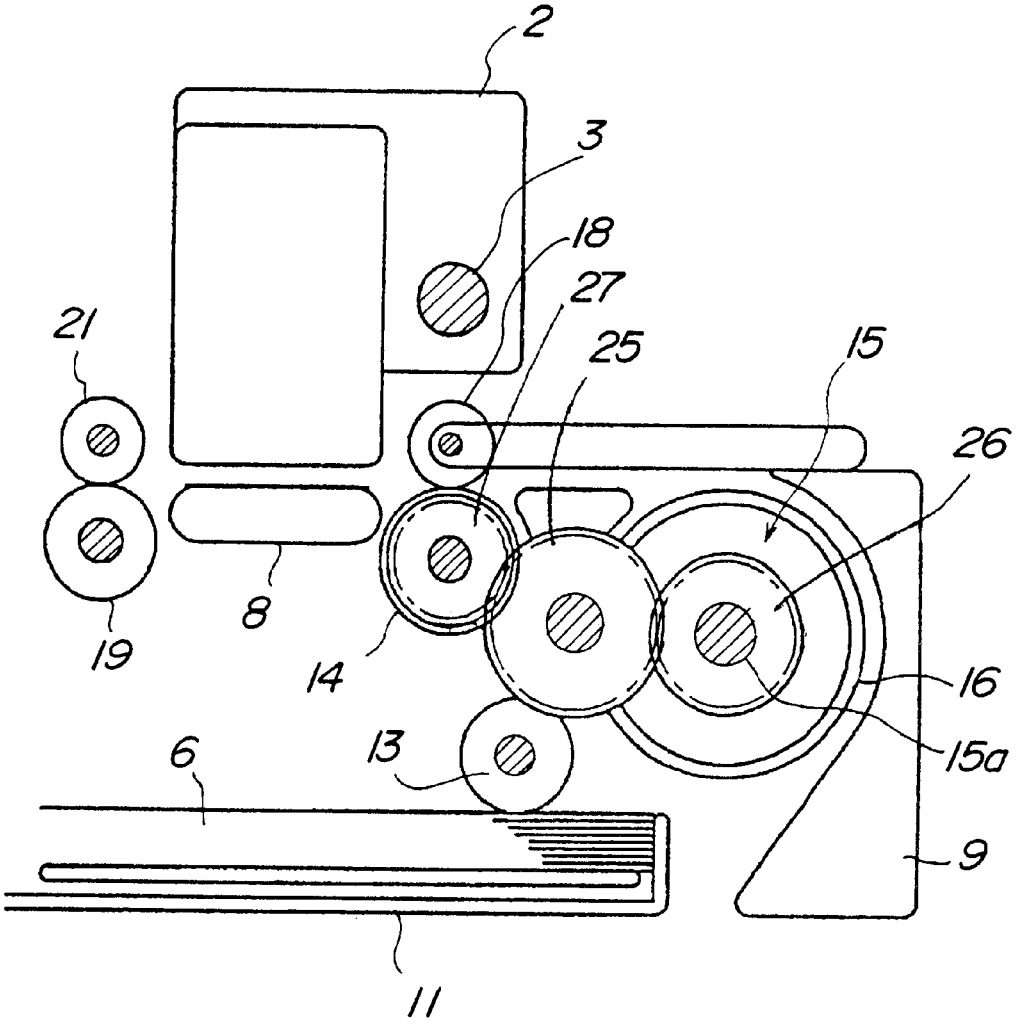
FIG. 4 is a cross section showing an essential structure of a recording apparatus according to the third embodiment of the invention.

Next, referring to FIG. 4, the third embodiment of the invention is described. FIG. 4 is a cross section showing an essential structure of a recording apparatus according to the third embodiment of the invention.

In this embodiment, as shown in FIG. 4, a conveyance roller gear 27 is provided to be secured not rotatively to the conveying roller 14, and drive force is given to the U-turn roller gear 26 secured not rotatively to the U-turn roller 15 via the idle gear 25. That is, the U-turn roller 15 is always driven to rotate in synchrony with rotary drive of the conveying roller 14. Accordingly, the U-turn roller 15 thus driven to rotate serves to reduce the front side resistance of the feeding roller 13 and the rear side load of the conveyance roller 14 as described above.

With the gear structure as shown in FIG. 4, from designing the tooth number of the U-turn roller gear 26 to be a prescribed number, the relation between the peripheral speed of the conveying roller 14 and the peripheral speed of the U-turn roller 15 is so set that the peripheral speed of the U-turn roller 15 is faster than the peripheral speed of the conveying roller 14. With this structure, the rear load of the conveying roller 14 is surely reduced, and loosening of the recording paper 6 may not happen otherwise occurring due to faster conveyance speed on the upstream side, because the recording paper 6 is sent without being pressed by the U-turn roller 15.

Figure 12:
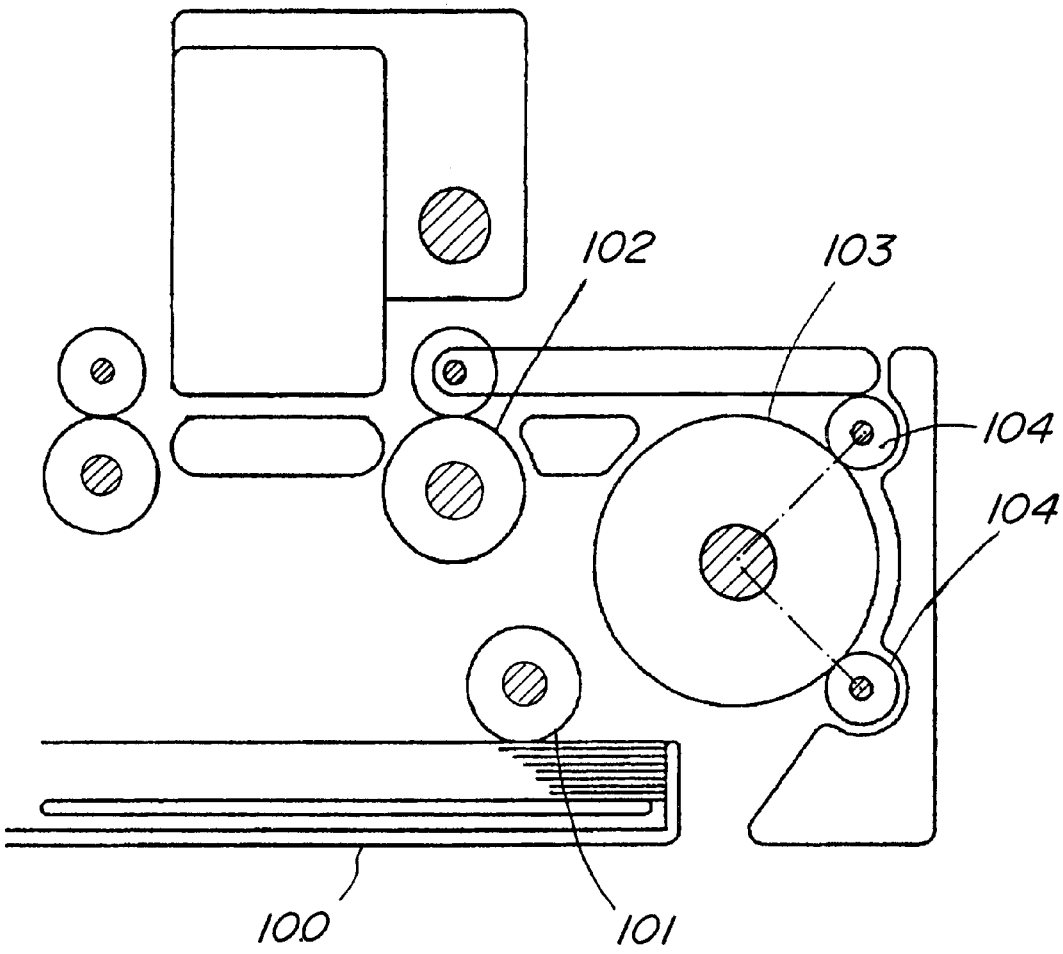
FIG. 12 is a cross section showing another conventional recording apparatus.

That is, even where the recording paper is overly pressed due to the fast peripheral speed of the U-turn roller 15, wrapping force of the recording paper 6 against the U-turn roller 15 is released because no member pressing the recording paper 6 exists like the pressing roller (see, FIG. 12) in the prior art, so that overly pressing force may not occur.

[Fourth Embodiment]

Figure 5:
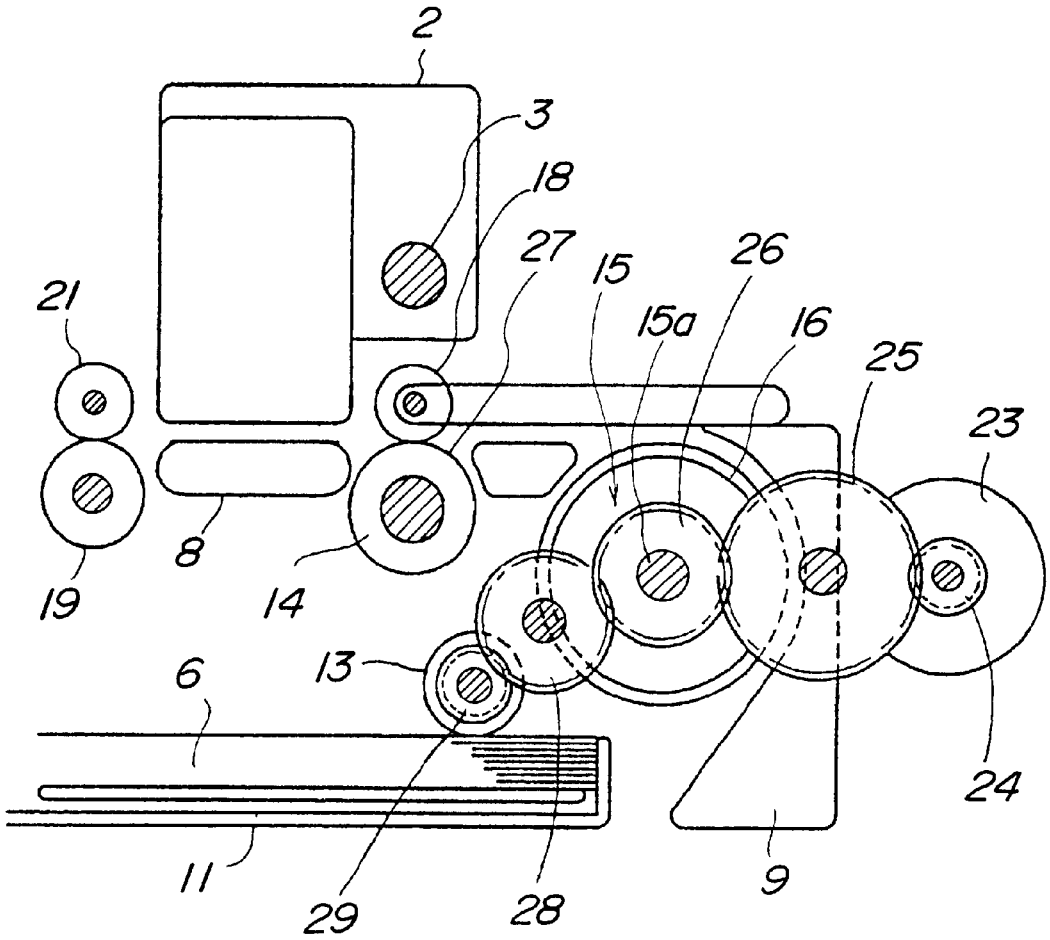
FIG. 5 is a cross section showing an essential structure of a recording apparatus according to the fourth embodiment of the invention.

Next, referring to FIG. 5, the fourth embodiment of the invention is described. FIG. 5 is a cross section showing an essential structure of a recording apparatus according to the fourth embodiment of the invention.

In this embodiment, as shown in FIG. 5, the U-turn roller motor 23 is arranged, and drive force is given to the U-turn roller gear 26 secured not rotatively to the U-turn roller 15 via the idle gear 25 from the drive gear 24. The above structure is substantially the same as the second embodiment shown in FIG. 3. This embodiment further has a structure in which drive force is given to the feeding roller gear 29 secured not rotatively to the feeding roller 13 via the idle gear 28 from the U-turn roller gear 26. That is, the U-turn roller 15 is always driven to rotate in association with rotary drive of the feeding roller 13. Accordingly, the U-turn roller 15 thus driven to rotate serves to reduce the front side resistance of the feeding roller 13 and the rear side load of the conveyance roller 14 as described above.

With the gear structure as shown in FIG. 5, the relation between the peripheral speed of the feeding roller 14 and the peripheral speed of the U-turn roller 15 is so set that the peripheral speed of the U-turn roller 15 is faster than the peripheral speed of the feeding roller 13. With this structure, the front side resistance of the feeding roller 13 is surely reduced.

[Fifth Embodiment]

Figure 6:
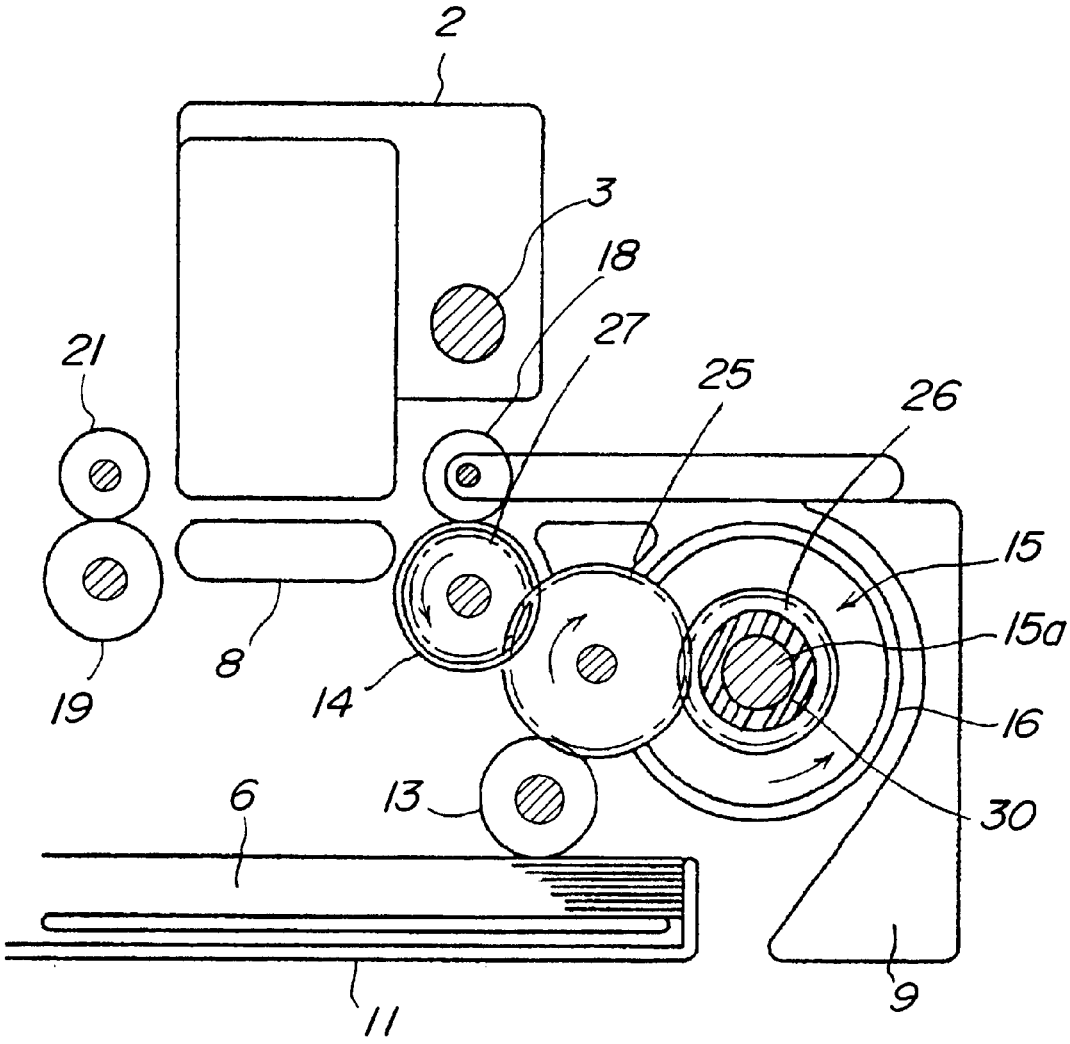
FIG. 6 is a cross section showing an essential structure of a recording apparatus according to the fifth embodiment of the invention.

Referring to FIG. 6, the fifth embodiment of the invention is described. FIG. 6 is a cross section showing an essential structure of a recording apparatus according to the fifth embodiment of the invention.

In this embodiment, as shown in FIG. 6, the conveying roller gear 27 secured not rotatively to the conveying roller 14 is arranged, and drive force is given to the U-turn roller gear 26 via the idle gear 25. A U-turn roller clutch 30 serving as an one-way drive transmission mechanism is provided between the U-turn roller gear 26 and the U-turn roller 15, and thereby, the rotation in the normal direction (arrow direction in FIG. 6) of the conveying roller 14 only is transmitted to the U-turn roller 15. That is, the U-turn roller 15 always drives to rotate in association with drive for normal rotation of the conveying roller 14, and the U-turn roller 15 does not drive to rotate during drive for reverse rotation of the conveying roller 14. Accordingly, the U-turn roller 15 thus driven to rotate in the normal direction serves to reduce the front side resistance of the feeding roller 13 and the rear side load of the conveyance roller 14 as described above.

[Sixth Embodiment]

Figure 7:
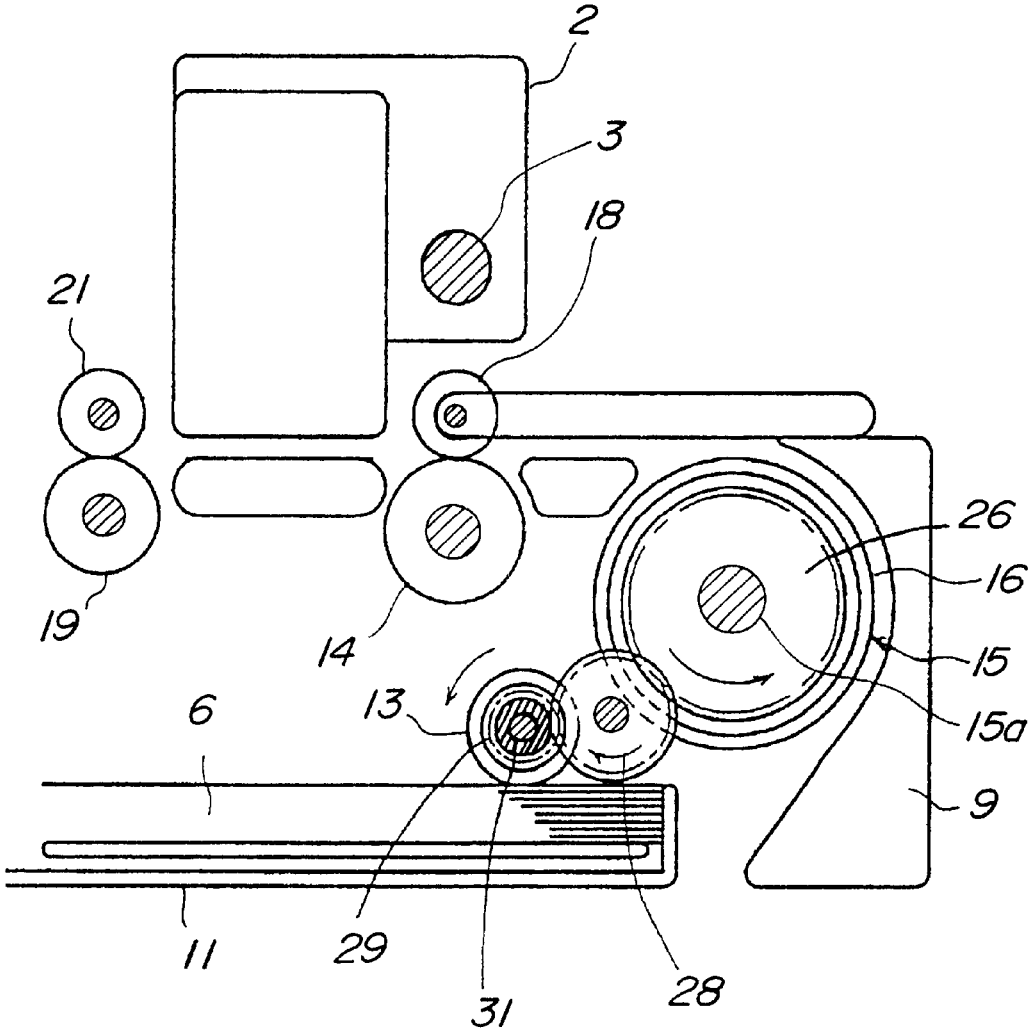
FIG. 7 is a cross section showing an essential structure of a recording apparatus according to the sixth embodiment of the invention.

Referring to FIG. 7, the sixth embodiment of the invention is described. FIG. 7 is a cross section showing an essential structure of a recording apparatus according to the sixth embodiment of the invention.

In this embodiment, as shown in FIG. 7, rotation force of the feeding roller 13 is transmitted to the feeding roller gear 29 via a feeding roller clutch 31 serving as a one-way drive transmission mechanism permitting rotation of only one direction. The feeding roller clutch 31 transmits only the rotation in the normal direction (arrow direction in FIG. 7) of the feeding roller 13 to the feeding roller gear 29. The rotary force thus transmitted is transmitted to the U-turn roller gear 26 secured not rotatively to the U-turn roller 15 via the feeding idle gear 28. That is, the U-turn roller 15 always drives to rotate in association with drive for normal rotation of the feeding roller 13, and when the feeding roller 13 is driven to rotate in the reverse direction, the U-turn roller 15 does not drive to rotate in association with the above rotation. While the feeding roller 13 is in a still state, the U-turn roller 15 freely rotates in the normal direction, and the conveying roller 14 conveys the recording paper 6, so that load becomes subtle even where the recording paper 6 rotates the U-turn roller 15. Therefore, the U-turn roller 15 thus driven to rotate in the normal direction serves to reduce the front side resistance of the feeding roller 13 as described above, and also serves to reduce the rear side load of the conveying roller 14 even where the U-turn roller 15 stops.

[Seventh Embodiment]

Figure 8:
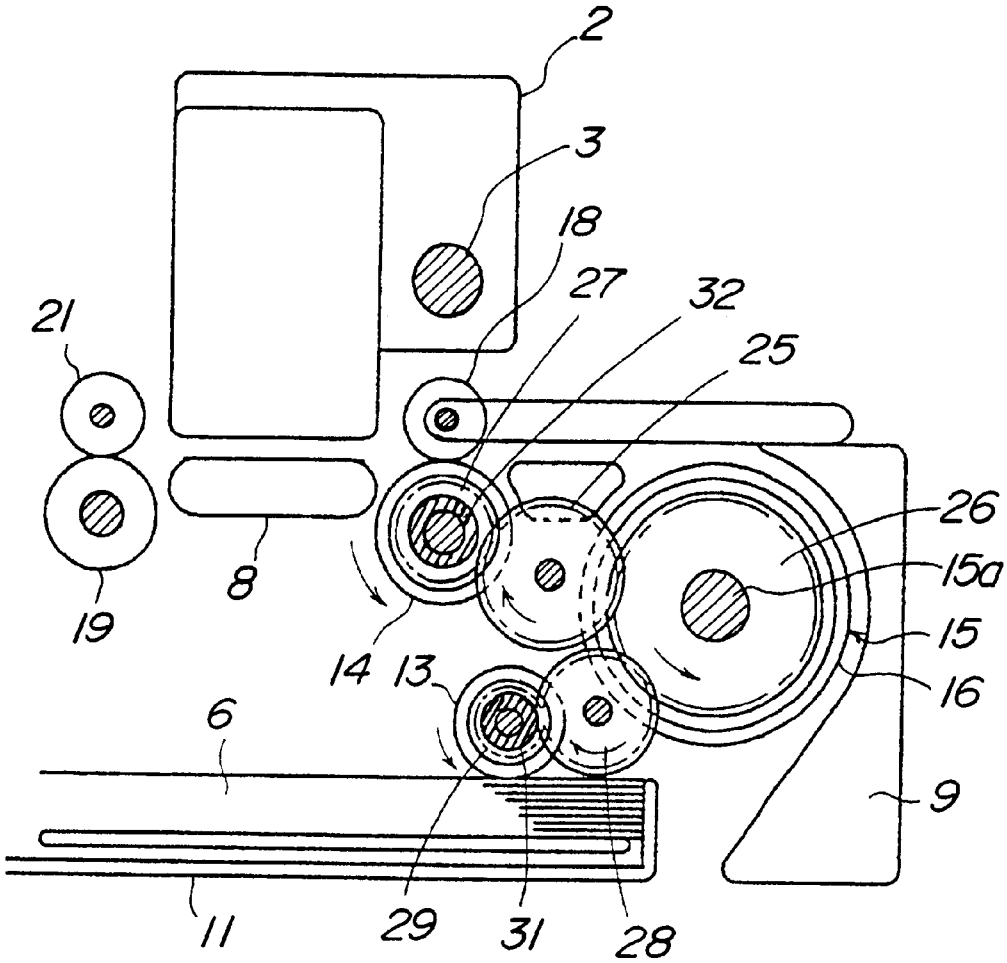
FIG. 8 is a cross section showing an essential structure of a recording apparatus according to the seventh embodiment of the invention.

Referring to FIG. 8, the seventh embodiment of the invention is described. FIG. 8 is a cross section showing an essential structure of a recording apparatus according to the seventh embodiment of the invention.

In this embodiment, as shown in FIG. 8, rotation force of the feeding roller 13 is transmitted to the feeding roller gear 29 via a feeding roller clutch 31 serving as a one-way drive transmission mechanism. The feeding roller clutch 31 transmits only the rotation in the normal direction (arrow direction in FIG. 8) of the feeding roller 13 to the feeding roller gear 29. The rotary force thus transmitted is transmitted to the U-turn roller gear 26 secured not rotatively to the U-turn roller 15 via the feeding idle gear 28. That is, the U-turn roller 15 always drives to rotate in association with drive for normal rotation of the feeding roller 13, and the U-turn roller 15 does not drive to rotate if the feeding roller 13 is driven to rotate in the reverse direction. While the feeding roller 13 is in a still state, the U-turn roller 15 can freely rotate in the normal direction. The above structure is substantially the same as the sixth embodiment shown in FIG. 7, but this embodiment is added with the following structures.

Rotation force of the conveying roller 14 is transmitted to the conveying roller gear 27 via a conveying roller clutch 32 serving as a one-way drive transmission mechanism. The conveying roller clutch 32 transmits only the rotation in the normal direction (arrow direction in FIG. 8) of the conveying roller 14 to the conveying roller gear 27. The rotary force thus transmitted is transmitted to the U-turn roller gear 26 secured not rotatively to the U-turn roller 15 via the idle gear 25. That is, the U-turn roller 15 always drives to rotate when the conveying roller 14 drives in the normal direction, and the U-turn roller 15 does not drive to rotate if the conveying roller 14 is driven to rotate in the reverse direction.

Accordingly, where any one of the feeding roller 13 and the conveying roller 14 rotates, the U-turn roller 15 is made to rotate. Even where both of the feeding roller 13 and the conveying roller 14 rotate, the rotations of the feeding roller 13 and the conveying roller 14 do not interfere with each other, and the U-turn roller 15 can be rotated at a rate of a side rotating the U-turn roller 15 at a higher rate. Even where any one of the feeding roller 13 and the conveying roller 14 is stopped, such a stop does not become conveyance load or resistance on the other roller, and the U-turn roller 15 as described above serves to reduce the rear side load of the conveyance roller 14 and the front side resistance of the feeding roller 13.

[Eighth Embodiment]

Figure 9:
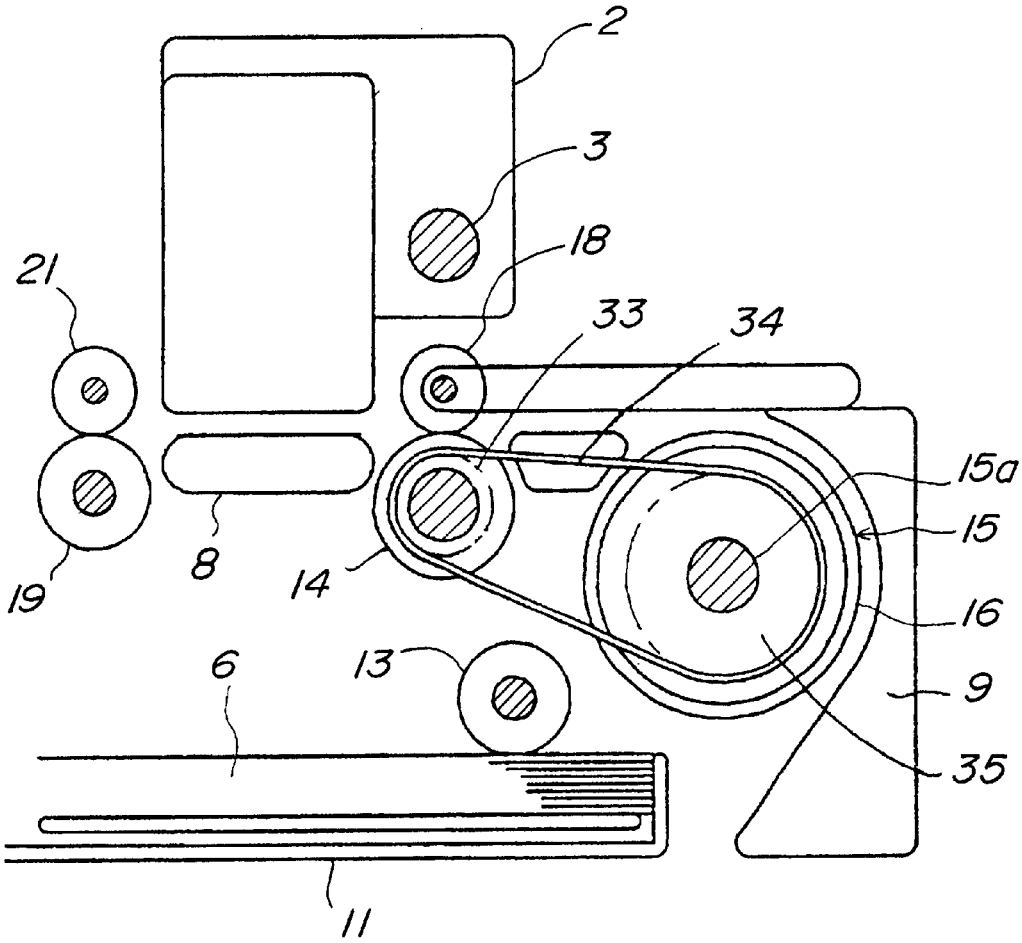
FIG. 9 is a cross section showing an essential structure of a recording apparatus according to the eighth embodiment of the invention.

Referring to FIG. 9, the eighth embodiment of the invention is described. FIG. 9 is a cross section showing an essential structure of a recording apparatus according to the eighth embodiment of the invention.

In this embodiment, as shown in FIG. 9, a conveying roller pulley 33 secured not rotatively to the conveying roller 14 is arranged, and drive force is given to a U-turn roller pulley 35 secured not rotatively to the U-turn roller 15 via a belt 34. That is, when the conveying roller 14 drives to rotate, the U-turn roller 15 always drives to rotate. The U-turn roller 15 thus driven to rotate serves to reduce the front side resistance of the feeding roller 13 and the rear side load of the conveyance roller 14 as described above.

[Ninth Embodiment]

Figure 10:
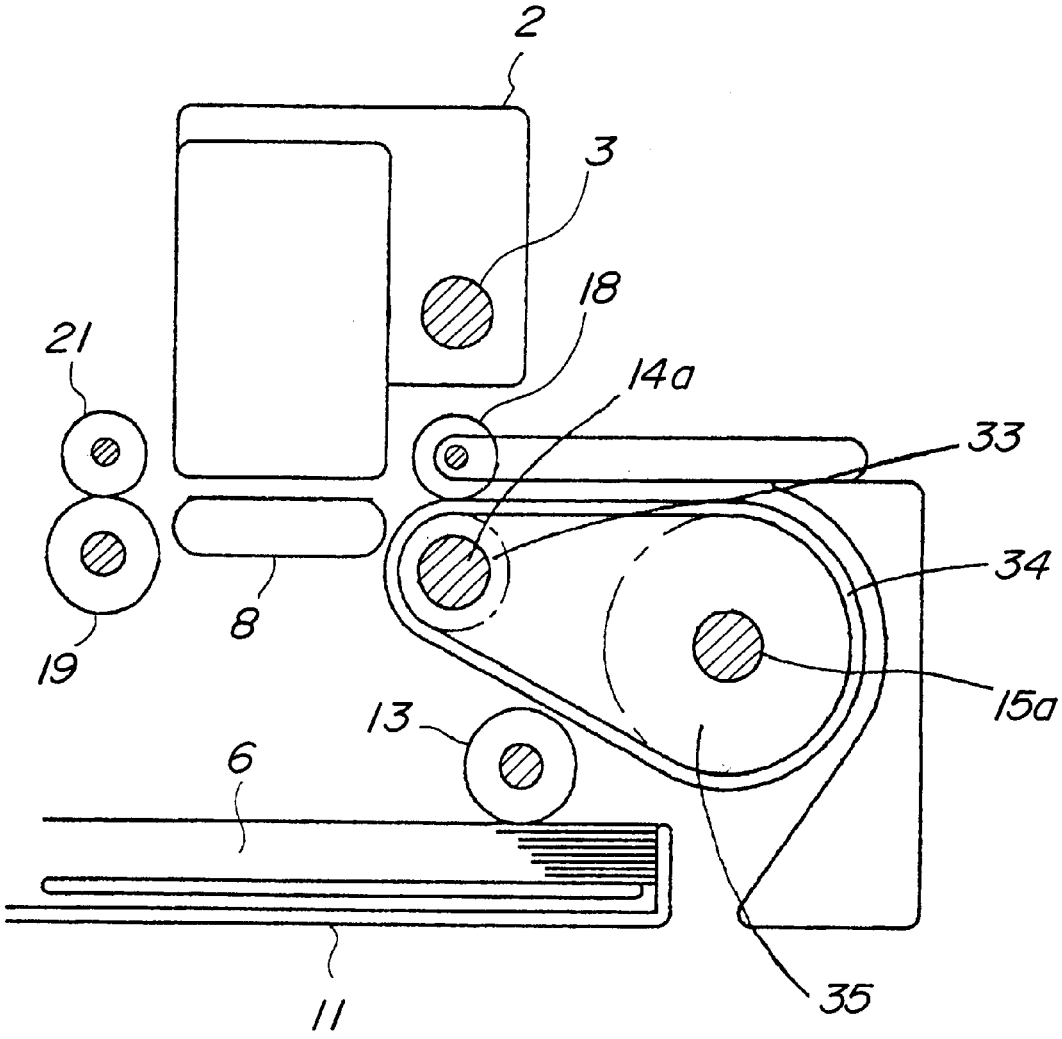
FIG. 10 is a cross section showing an essential structure of a recording apparatus according to the ninth embodiment of the invention.

Referring to FIG. 10, the ninth embodiment of the invention is described. FIG. 10 is a cross section showing an essential structure of a recording apparatus according to the ninth embodiment of the invention.

In this embodiment, as shown in FIG. 10, the conveying roller pulley 33 secured not rotatively to the conveying roller bearing 14*a* is arranged, and similarly, the U-turn roller pulley 35 secured not rotatively to the U-turn roller bearing 15*a* is arranged. The belt 34 is suspended around the conveying roller pulley 33 and the U-turn roller pulley 35, and the conveying roller bearing 14*a* and the U-turn roller pulley 15*a* are driven at the same time. The recording paper is conveyed by frictional force of the belt 34. Such belt conveyance serves to reduce the front side resistance of the feeding roller 13 and the rear side load of the belt 34 as described above.

[Other Embodiments]

Although in the above embodiments, the curving conveyance route is exemplified as a conveyance route having a U-turn shape in which the conveyance direction is turned by about 180 degrees, this invention is applicable to any curving conveyance route, notwithstanding the angle, located between the feeding means (feeding roller 13) serving as the first conveying means and the conveying means (conveying roller 14) serving as the second conveying means.

In the embodiments as described above, a member pressing to a rotary body (e.g., U-turn roller 15) as a guide member located on an inner side forming the curving conveyance route indicates a member to produce conveyance force for the recording paper 6 by the U-turn roller 15 by pressing the recording paper 6 with that pressing member. That is, the above pressing member does not include members such as U-turn guide 9 functioning as a guide member guiding the recording paper 6.

With the above structure, the movable U-turn roller 15 can serve to reduce the front side resistance of the feeding roller 13 and the rear side load of the conveying roller 14 as described above.

As described above, according to the invention, among the guide members forming the curving conveyance route between the first conveying means and the second conveying means, the guide member located on an inner side is formed of a rotatable rotary body, and the structure has no pressing member for pressing the sheet material to the rotary body, so that the apparatus can prevent the conveyance accuracy from becoming worse during recording medium conveyance by the conveying means and also prevent the product costs for increasing conveyance power of the conveying means from becoming higher.

What is claimed is:

1. A sheet material conveying apparatus comprising:

first conveying means for conveying a sheet material;

a rotary body for U-turning the sheet material conveyed by said first conveying means, said rotary body being located on an inner side of the conveyed sheet material, wherein said rotary body is arranged so that a peripheral surface of said rotary body does not contact any other member except the sheet material;

second conveying means for conveying the sheet material conveyed by said rotary body, such that when said second conveying means receives the sheet material, a rear portion of the sheet material is located at said rotary body; and a carriage for holding and moving a recording means in a widthwise direction of the sheet material conveyed by said second conveying means, wherein moving of said carriage and conveying of the sheet material by said second conveying means are alternately repeated, and wherein said rotary body is driven at a higher conveyance speed than that of said second conveying means.

2. The sheet material conveying apparatus according to claim 1, wherein said rotary body is driven by a motor for driving said second conveying means.

3. The sheet material conveying apparatus according to claim 2, wherein said rotary body is driven at a higher conveyance speed than that of said second conveying means.

4. The sheet material conveying apparatus according to claim 1, wherein said rotary body is driven by a motor for driving said first conveying means.

5. The sheet material conveying apparatus according to claim 4, wherein said rotary body is driven at a higher conveyance speed than that of said first conveying means.

6. The sheet material conveying apparatus according to claim 1, wherein said rotary body is driven through a one-way drive transmission mechanism.

7. The sheet material conveying apparatus according to claim 1, wherein said rotary body is driven by means of a drive belt.

8. The sheet material conveying apparatus according to claim 1, wherein said rotary body has an outer peripheral portion whose material is different from a material forming a bearing of said rotary body.

9. The sheet material conveying apparatus according to claim 8, wherein a frictional coefficient of the material of the outer peripheral portion of said rotary body is larger than a frictional coefficient of the material of the bearing of said rotary body.

10. The sheet material conveying apparatus according to claim 9, wherein said rotary body has a surface made of a material whose frictional coefficient is 0.5 or higher.

11. The sheet material conveying apparatus according to claim 1, wherein said first conveying means is a feeding means for feeding sheet materials sheet by sheet separately, and wherein said second conveying means is a conveying means for conveying the sheet materials separately fed.

12. A recording apparatus for recording images on a sheet material, comprising:

first conveying means for conveying a sheet material;

a rotary body and U-turn guide for U-turning the sheet material conveyed by said first conveying means, said rotary body being located on an inner side of the conveyed sheet material, wherein said rotary body is arranged so that a peripheral surface of said rotary body does not contact any other member except the sheet material;

second conveying means for conveying the sheet material conveyed by said rotary body, such that when said second conveying means receives the sheet material, a rear portion of the sheet material is located at said rotary body; and a carriage for holding and moving a recording means in a widthwise direction of the sheet material conveyed by said second conveying means, wherein moving of said carriage and conveying of the sheet material by said second conveying means are alternately repeated, and wherein said rotary body is driven at a higher conveyance speed than that of said first conveying means.

13. A recording apparatus according to claim 12, wherein said rotary body is driven through a one-way drive transmission mechanism.

14. A recording apparatus according to claim 12, wherein said rotary body is driven by means of a drive belt.

15. A recording apparatus according to claim 12, wherein said rotary body has an outer peripheral portion whose material is different from a material making a bearing of said rotary body.

16. A recording apparatus according to claim 15, wherein a frictional coefficient of the material of the outer peripheral portion of said rotary body is larger than a frictional coefficient of the material of the bearing of said rotary body.

17. A recording apparatus according to claim 16, wherein said rotary body has a surface made of material whose frictional coefficient is 0.5 or higher.

18. A recording apparatus according to claim 12, wherein said first conveying means is a feeding means for feeding sheet material sheet by sheet separately, and wherein said second conveying means is a conveying means for conveying the sheet materials separately fed.

19. A recording apparatus for recording images on a sheet material, comprising:

first conveying means for conveying a sheet material;

a rotary body and U-turn guide for U-turning the sheet material conveyed by said first conveying means, said rotary body being located on an inner side of the conveyed sheet material, wherein said rotary body is arranged so that a peripheral surface of said rotary body does not contact any other member except the sheet material;

second conveying means for conveying the sheet material conveyed by said rotary body, such that when said second conveying means receives the sheet material, a rear portion of the sheet material is located at said rotary body; and a carriage for holding and moving a recording means in a widthwise direction of the sheet material conveyed by said second conveying means, wherein moving of said carriage and conveying of the sheet material by said second conveying means are alternately repeated, and wherein said rotary body is mounted rotatably so that said rotary body is driven by the sheet material conveyed by said second conveying means.

* * * * *